US010857443B1

(12) United States Patent
Presby et al.

(10) Patent No.: US 10,857,443 B1
(45) Date of Patent: Dec. 8, 2020

(54) GOLF SWING TRAINING CLUB

(71) Applicants: Herman Presby, Highland Park, NJ (US); Benjamin S. Wallace, Edison, NJ (US)

(72) Inventors: Herman Presby, Highland Park, NJ (US); Benjamin S. Wallace, Edison, NJ (US)

( * ) Notice: Subject to any disclaimer, the term of this patent is extended or adjusted under 35 U.S.C. 154(b) by 0 days.

(21) Appl. No.: 16/691,223

(22) Filed: Nov. 21, 2019

(51) Int. Cl.
*A63B 69/36* (2006.01)
*A63B 53/06* (2015.01)

(52) U.S. Cl.
CPC ..... *A63B 69/3632* (2013.01); *A63B 69/3685* (2013.01); *A63B 2069/3626* (2013.01)

(58) Field of Classification Search
CPC ..... A63B 69/3632; A63B 69/3685; A63B 2069/3626
USPC ..... 473/219, 256, 257, 314, 316, 318, 319, 473/320, 323, 377
See application file for complete search history.

(56) References Cited

U.S. PATENT DOCUMENTS 3,229,980 A * 1/1966 Silberman ..... A63B 69/3632 473/232
3,646,610 A * 2/1972 Jackson ..... A63B 53/10 473/319
4,118,033 A * 10/1978 Miyamoto ..... A63B 15/00 473/256
4,558,863 A * 12/1985 Haas ..... A63B 53/10 473/323
4,757,997 A * 7/1988 Roy ..... A63B 53/10 473/319
5,026,063 A 6/1991 Rhodes
5,083,780 A * 1/1992 Walton ..... A63B 53/10 473/320
5,259,617 A * 11/1993 Soong ..... A63B 53/02 473/305
6,322,460 B1 * 11/2001 Asci ..... A63B 69/0002 24/114.5
2007/0049431 A1 * 3/2007 Meyer ..... F41B 15/02 473/513
2008/0293510 A1 * 11/2008 Yamamoto ..... A63B 53/02 473/308
2012/0071257 A1 * 3/2012 Lum ..... A63B 69/3623 473/256
2012/0322572 A1 * 12/2012 Noble ..... A63B 53/10 473/289

* cited by examiner

*Primary Examiner* — Nini F Legesse
(74) *Attorney, Agent, or Firm* — Marc Van Dyke; Momentum IP Group

(57) ABSTRACT

A golf swing training club comprising: (a) a shaft; (b) a golf head attached to a first, lower end of the shaft; and (c) a handgrip attached to a second, upper end of the shaft; wherein a standard longitudinal shaft bending angle (β) of the shaft is within a range of 45° to 90°; and wherein a mechanical beam portion of the golf swing training club is characterized by a standard extensive shear modulus of at most 15°.

20 Claims, 4 Drawing Sheets

GOLF SWING TRAINING CLUB

FIELD AND BACKGROUND OF THE INVENTION

The present invention relates to a golf swing training club for promoting a correct swing motion.

While many such training golf clubs exist, the present inventors have found that many fail to improve the user's swing motion, and in some cases, various known training golf clubs may actually strengthen certain impediments in the user's swing motion. Thus, the present inventors have recognized a need for improved training golf clubs.

SUMMARY OF THE INVENTION

According to teachings of the present invention there is provided a golf swing training club comprising: (a) a shaft; (b) a golf head attached to a first, lower end of the shaft; and (c) a handgrip attached to a second, upper end of the shaft; wherein a standard longitudinal shaft bending angle (β) of the shaft is within a range of 45° to 90°; and wherein a mechanical beam portion of the golf swing training club is characterized by a standard extensive shear modulus (or standard angular deflection) of at most 15°.

According to teachings of the present invention there is provided a swing training club comprising: (a) a shaft; (b) a golf head attached to a first, lower end of the shaft; and (c) a handgrip attached to a second, upper end of the shaft; wherein a portion of the shaft that is disposed between the handgrip and the golf head includes a braided layer or braided hose.

According to teachings of the present invention there is provided a golf swing training club comprising: (a) a shaft; (b) a golf head attached to a first, lower end of the shaft; and (c) a handgrip attached to a second, upper end of the shaft; wherein a portion of the shaft that is disposed between the handgrip and the golf head has, or includes an element having: (i) a flexural modulus of at most 0.05 GPa; and (ii) a shear modulus of at least 1.0 GPa.

According to still further features in the described preferred embodiments, the braided layer or braided hose is or includes a metal braided layer or metal braided hose.

According to still further features in the described preferred embodiments, the portion of the shaft that is disposed between the handgrip and the golf head has, or includes an element having a shear modulus of at least 2 GPa, at least 3 GPa, at least 5 GPa, at least 7 GPa, or at least 10 GPa.

According to still further features in the described preferred embodiments, the golf swing training club comprises a tube disposed underneath the braided layer or braided hose.

According to still further features in the described preferred embodiments, the tube has a flexural modulus of at most 0.05 GPa, at most 0.03 GPa, at most 0.01 GPa, at most 0.005 GPa, or at most 0.002 GPa.

According to still further features in the described preferred embodiments, the golf head is reversibly detachable from said shaft.

According to still further features in the described preferred embodiments, the golf head is a putting head.

According to still further features in the described preferred embodiments, the golf head is a driving head.

According to still further features in the described preferred embodiments, the golf head is an iron.

According to still further features in the described preferred embodiments, the standard longitudinal shaft bending angle (β) of the shaft is at least 50°, at least 60°, at least 70°, at least 80°, or at least 85°.

According to still further features in the described preferred embodiments, the standard longitudinal shaft bending angle (β) of the shaft is within a range of 55° to 90°, 65° to 90°, 75° to 90°, 75° to 89°, 75° to 88°, 55° to 85°, 65° to 85°, or 75° to 85°.

According to still further features in the described preferred embodiments, the standard extensive shear modulus is at most 12°, at most 10°, at most 8°, or at most 6°.

According to still further features in the described preferred embodiments, the standard extensive shear modulus is at least 2°.

According to still further features in the described preferred embodiments, the standard extensive shear modulus is within a range of 2° to 15°, 2° to 12°, 2° to 10°, 2° to 8°, 3° to 15°, 3° to 12°, 3° to 10°, 3° to 8°, 4° to 12°, 4° to 10°, 4° to 8°, 5° to 12°, or 5° to 10°.

According to still further features in the described preferred embodiments, the flexural modulus of the element is at most 0.04 GPa, at most 0.03 GPa, at most 0.02 GPa, at most 0.01 GPa, at most 0.005 GPa, at most 0.004 GPa, at most 0.003 GPa, at most 0.0025 GPa, at most 0.002 GPa, or at most 0.0015 GPa.

According to still further features in the described preferred embodiments, the flexural modulus of the element is at least 0.0001 GPa, and typically, within a range of 0.0001 to 0.04 GPa, 0.0001 to 0.01 GPa, 0.0001 to 0.005 GPa, 0.0001 to 0.003 GPa, 0.0001 to 0.002 GPa, 0.0002 to 0.005 GPa, 0.0005 to 0.005 GPa, or 0.0005 to 0.003 GPa.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. Throughout the drawings, like-referenced characters are used to designate like elements.

In the drawings.

DESCRIPTION OF THE PREFERRED EMBODIMENTS

Figure 1:
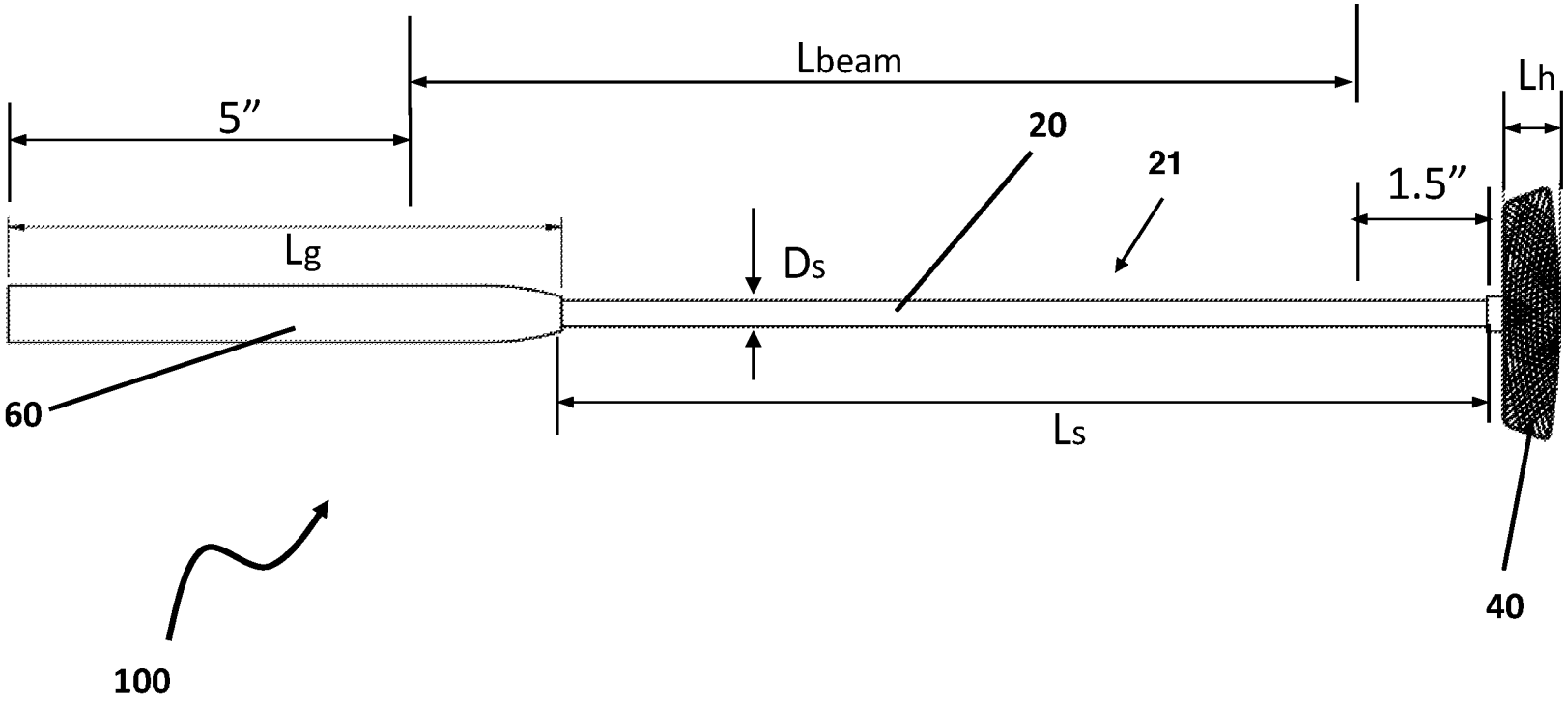
FIG. 1 is a schematic side view of a training club embodying the invention.

The principles and operation of the golf swing training club according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

The present invention provides a dynamic training tool whose repeated use will help a golfer to feel the proper golf swing, and ultimately, to improve the golf swing when golfing using a regular golf club.

The inventors have found that golfers can better learn the feel of a proper swing by using a training club having a flexible, substantially non-resilient shaft. The inventors have further found that learning the feel of a proper swing, without the follow-up step of proper striking of the golf ball, may substantially mitigate the benefit derived from the swing improvement. However, the inventors have found that by compounding the structural feature of a flexible, substantially non-resilient shaft with another structural feature—strong resistance of the shaft to torque (i.e., about the shaft axis), the efficacy of the golf swing training club is appreciably enhanced. These structural features are embodied in the training club described hereinbelow.

With reference now to the figures, FIG. 1 is a schematic side view of a golf swing training club 100 embodying the invention. Training club 100 includes a shaft 20 having a length Ls, a golf head 40, having a length (along shaft 20) Lh, attached to a first or lower end of shaft 20, and a handgrip 60 having a length Lg, attached to a second or upper end of shaft 20. The shaft may extend through at least a portion (and typically the entire length) of handgrip 60. In this case, the shaft length is defined so as to include the length of the shaft covered by the handgrip.

During the swing, shaft 20 along with the portion of handgrip 60 disposed beneath the hands, form a mechanical beam 21, whose length is the unsupported length of the shaft along with the length of the handgrip between the hands and the golf head.

In evaluating the mechanical properties of this beam, the top 5 inches of the handgrip are considered to be for hand placement, such that the beam length Lbeam is measured from below this point, until 1.5 inches from the opposite end of the shaft.

Figure 2:
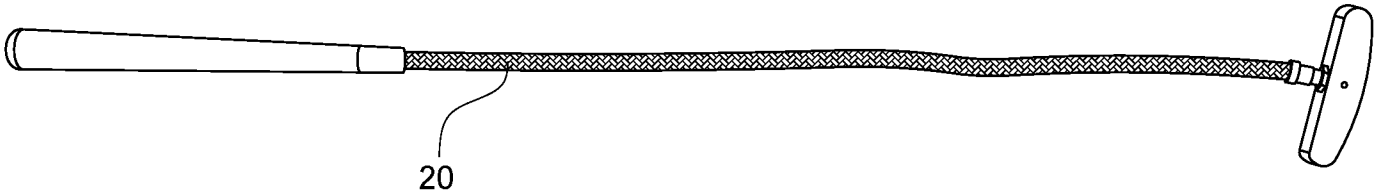
FIG. 2 is a side view of an actual embodiment of the inventive training club provided in FIG. 1.

FIG. 2 is a side view of an actual embodiment of the inventive training club provided in FIG. 1. In this exemplary embodiment, shaft 20 includes a braided layer forming a hose or tubular element.

The hose braiding for shaft 20 may be formed from steel or stainless steel, such as austenitic stainless steels. Titanium-stabilized stainless steels may be particularly suitable. Typically, the stainless steel is cold-rolled stainless steel. Other metals, notably bronze, may be used for the wires forming the braids. In some embodiments, various stiff fibers, such as carbon or aramid fibers, may be processed into hose braiding, or at least a portion thereof.

Both regular or standard braiding and knurled braiding may be suitable for forming the braided hose of the present invention. In standard braiding, the wires on the wire clapper are disposed in parallel to each other, while with knurled braiding, the individual wires of the clapper are additionally braided with each other.

Figure 3:
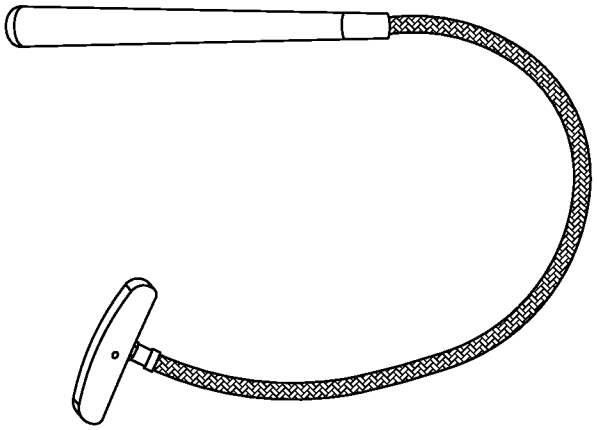
FIG. 3 is a side view of the inventive training club of FIG. 2, in which the inventive training club is in a curled-up position.

FIG. 3 is a side view of the inventive training club of FIG. 2, in which the inventive training club is in a curled-up position. This curled-up position is fully reversible. Moreover, in assuming this position, shaft 20 exhibits no appreciable resistance to curling up.

Figure 4:
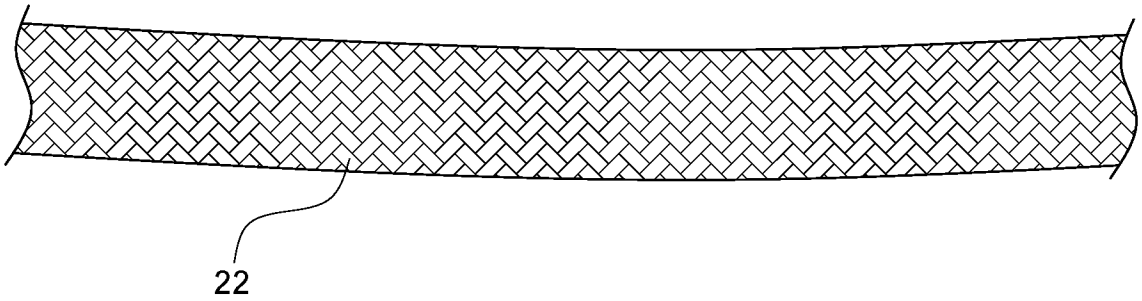
FIG. 4 is a side view, at an enlarged scale, of a portion of the shaft provided in FIG. 2.

FIG. 4 is a side view, at an enlarged scale, of a portion of the shaft provided in FIG. 2, in which the braided metal (hose) exterior 22 is better viewed.

Figure 5:
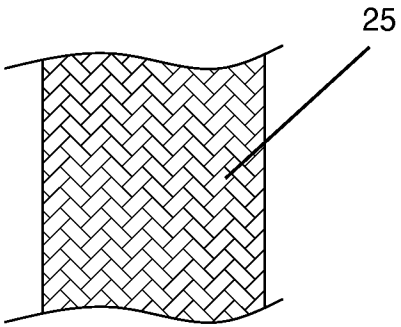
FIG. 5 is a schematic perspective view of a braided metal exterior for the shaft provided in FIG. 2, in accordance with an embodiment of the present invention.

FIG. 5 is a schematic perspective view of braided metal exterior 22, for use in accordance with an embodiment of the present invention. The braided structure may advantageously be configured in a "lazy tongs" 25 configuration having an axially expanded position and an axially contracted position. The expanded position may be attained by axial tension with the wires having the smallest crossing angles. The crossing angle and diameter increase to the largest value through axial contraction. When fabricated in a golf club shaft, such a configuration may exhibit excellent longitudinal flexibility, while maintaining good torque resistance (low angular deflection of the shaft or beam).

Figure 6:
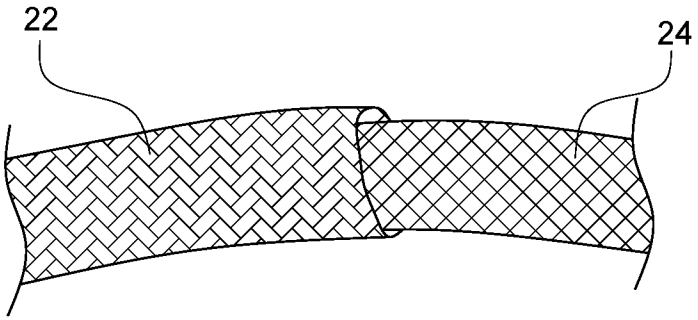
FIG. 6 is a side, partially cut-open view, at an enlarged scale, of a portion of the shaft provided in FIG. 2, in which is exposed an inner tube beneath the braided metal exterior.

FIG. 6 is a side, partially cut-open view, at an enlarged scale, of a portion of the shaft provided in FIG. 2, in which is exposed an optional inner tube or layer 24 beneath the braided metal exterior 22. Inner tube or layer 24 may be made of, or include, flexible rubber or flexible plastic. Inner tube or layer 24 may be disposed along an entire length of the shaft, or along a portion thereof.

Figure 7:
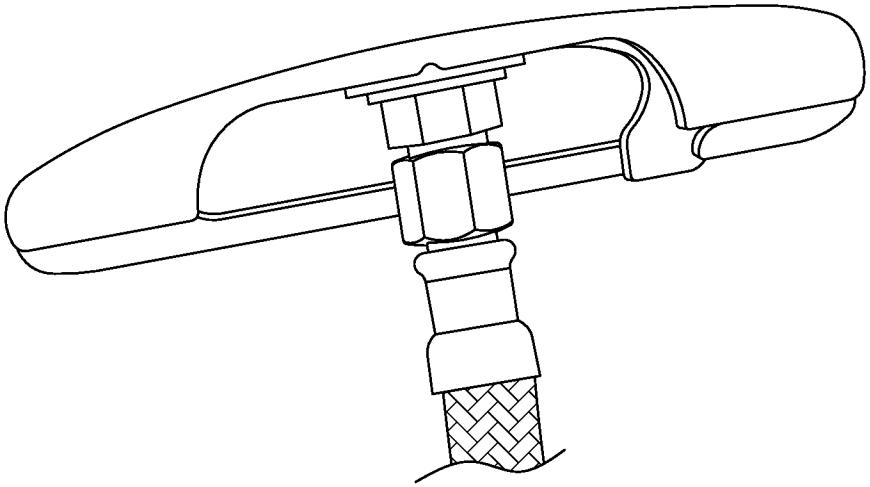
FIG. 7 is a rear view of the golf head provided in FIG. 2, in which is revealed an attachment assembly attaching the shaft to the golf head, in accordance with an embodiment of the present invention.

FIG. 7 is a rear view of the golf head provided in FIG. 2, in which is revealed an attachment assembly attaching the shaft to the golf head, in accordance with an embodiment of the present invention.

Typically, the golf head for use in conjunction with the present invention has a standard head weight. The inventors have found that in many instances, it may be deleterious to utilize a golf head having a head weight that above the standard head weight.

Thus, in some embodiments, the golf head has a weight of at most 400 grams, at most 380 grams, or at most 360 grams, and typically, within a range of 200 to 400 grams, 250 to 400 grams, 250 to 380 grams, 300 to 400 grams, 320 to 400 grams, 330 to 400 grams, 330 to 380 grams, or 330 to 370 grams.

The diameter of the shaft of the invention may be close to the diameter of a standard club which is about 0.5 in. The shaft diameter may be within a range of 0.2 to 1 inches, 0.35 to 0.8 inches, 0.35 to 0.7 inches, 0.35 to 0.65 inches, 0.35 to 0.6 inches, 0.35 to 0.55 inches, 0.4 to 0.8 inches, 0.4 to 0.7 inches, 0.4 to 0.65 inches, 0.4 to 0.6 inches, or 0.4 to 0.55 inches.

The shaft length may be of any practical length, but is typically within a range of 28 to 38 inches, 30 to 38 inches, 28 to 36 inches, 30 to 36 inches, or 32 to 36 inches.

The length of the total club may be of any practical length, but is typically within a range of 28 to 40 inches, 28 to 38 inches, 30 to 38 inches, 28 to 36 inches, 30 to 36 inches, or 32 to 36 inches.

EXAMPLES

Reference is now made to the following examples, which together with the above descriptions, illustrate the invention in a non-limiting fashion.

Example 1

Measurement Procedure: Extensive Shear Modulus

Shear modulus as an extensive property for golf clubs can be characterized by a shaft torque analyzer, e.g., an apparatus that measures the angular deflection of the shaft under standard and repeatable conditions. Commercially available apparatus for this purpose include the Auditor® 050312 digital shaft torque measuring machine.

Such shaft torque measuring machines are typically equipped with a torsion control head having a cradle adapted to receive a golf shaft. The torsion control head has a torsion arm, and may be adapted to receive a torsion weight at a predetermined position along the arm, so as to exert a predetermined load. In the measurement procedure used herein, the predetermined load is 1 pound/foot. When properly inserted, the shaft should protrude past the back (inwardly disposed) side of the torsion control head clamp by 1.5 inches.

The shaft torque measuring machine includes a shaft butt clamp, which is typically adapted to freely slide on a track having length scale marks, and to be locked at any desired position along the track. The shaft of the training golf club should protrude past the front (inwardly disposed) side of the shaft butt clamp by 5 inches.

The beam or mechanical beam length ($L_{beam}$) is the unsupported length of the shaft between the clamps, which is typically 6.5 inches less than the length of the total club, length ranges of which are provided hereinabove.

As used herein in the specification and in the claims section that follows, the term "mechanical beam" or "mechanical beam portion" refers to a mechanical beam whose length ("mechanical beam length") is at least 18 inches, as measured according to the procedure delineated in Example 1. More typically, the mechanical beam length is at least 20 inches or at least 22 inches, and yet more typically, within a range of 18 to 34 inches, 18 to 32 inches, 20 to 34 inches, 20 to 32 inches, 22 to 34 inches, 22 to 32 inches, 22 to 30 inches, or 24 to 30 inches.

As used herein in the specification and in the claims section that follows, the term "standard extensive shear modulus" refers to the angular deflection of the mechanical beam. This mechanical property is also termed "standard angular deflection".

Example 2

Measurement: Extensive Shear Modulus

The extensive shear modulus (expressed as angular deflection, in degrees) for various training golf clubs of the present invention was found to be at most 15°. More typically, the angular deflection was at most 12°, or at most 10°, at most 8°, or at most 6°. The angular deflection was at least 2°. The angular deflection was typically within a range of 2° to 15°, 2° to 12°, 2° to 10°, 2° to 8°, 3° to 15, 2°, 3° to 12°, 3° to 10°, 3° to 8°, 4° to 12°, 4° to 10°, 4° to 8°, 5° to 12°, or 5° to 10°.

Utilizing thicker wires for the braiding, utilizing stiffer materials of construction, and utilizing more than one layer of braiding all contribute to a reduction in the angular deflection.

Example 3

Measurement Procedure: Extensive Bending

Extensive longitudinal (i.e., along the length of the shaft axis) bending of the shaft may be characterized by the angle the shaft makes when held horizontally, using a putting head of standard weight −350 grams.

The shaft is held or supported solely on the handgrip side, such that the length of the free beam between the hold position and the putting head is 20 inches. The downward bend or vertical dip ("DIP LENGTH", or $L_{dip}$) from horizontal is measured, in inches, as is the resultant horizontal extension ("HORIZONTAL LENGTH", or $L_{hor}$). The standard shaft bending angle (in degrees) may be calculated by the following formula:

$$\text{standard longitudinal shaft bending angle}(\beta)=\tan^{-1}(L_{dip}/L_{hor})$$

Thus, for an idealized, non-bending shaft, $L_{dip}=0$ and $L_{hor}=20$, such that the standard longitudinal shaft bending angle ($\beta$)=0°. For an idealized, fully-bending shaft, $L_{dip}=20$ and $L_{hor}=0$, such that the standard longitudinal shaft bending angle ($\beta$)=90°.

As used herein in the specification and in the claims section that follows, the term "standard longitudinal shaft bending angle", and the like, $\beta$, refers to the angular deflection of the mechanical beam, in degrees, measured according to the procedure delineated in Example 1, for a mechanical beam length within a range of 18 to 34 inches. This mechanical property is also termed "standard angular deflection".

Example 4

Various standard golf clubs were tested using the extensive bending procedure provided in Example 3. In all cases, the shaft bending angle ($\beta$) was less than 1°, in some cases, considerably less than 1°.

Example 5

Various golf swing training clubs of the present invention were evaluated using the extensive bending procedure provided in Example 3. In most cases, the bending angle ($\beta$) approached 90°, and in all cases, the bending angle ($\beta$) was within the range of 45° to 90°.

Example 6

Measurement Procedure: Intensive Flexural Modulus

The flexural modulus for golf club shaft materials can be characterized by various bending tests. While we have adopted the general approach of ASTM D790, the skilled practitioner will readily appreciate that other bending tests may be particularly suitable. The skilled practitioner will also readily appreciate that bend test applications are common in various industries, and that universal testing machines equipped with bend fixtures are known for measuring/calculating the intrinsic and extrinsic flexural modulus.

The ASTM D790 approach utilizes three-point bend fixtures, in which the specimen (in this case, the material of construction of the shaft) is loaded at a location midway between two support bearings. ASTM D790 is typically used to measure the flexural strength and flexural modulus of unreinforced and reinforced plastics, including high-modulus composites.

Example 7

Below are provided the flexural modulus of various materials of construction for use as shaft materials in golf swing training clubs, as characterized by ASTM D790.

| POLYMER TYPE | Flexural Modulus (GPa) |
|---|---|
| Acetal Copolymer | 2.5 |
| Acrylic | 3 |
| Nylon 6 | 2.3 |
| Polyamide-Imide | 5 |
| Polycarbonate | 2.3 |
| Polyethylene, MDPE | 0.7 |
| Polyethylene Terephthalate (PET) | 1 |
| Polyimide | 3 |
| Polyimide + Glass Fiber | 12 |
| Polypropylene | 1.5 |
| Polystyrene | 2.5 |
| PVC-plasticized/unfilled | 3 |
| PVC-foam grade | 0.04 |
| PVC-plasticized | 0.001 |
| Rubber1 | 0.0007 |
| Rubber2 | 0.003 |

In the context of the present application and claims, the phrase "at least one of A and B" is equivalent to an inclusive "or", and includes any one of "only A", "only B", or "A and B". Similarly, the phrase "at least one of A, B, and C" is equivalent to an inclusive "or", and includes any one of "only A", "only B", "only C", "A and B", "A and C", "B and C", or "A and B and C".

As used herein in the specification and in the claims section that follows, the terms "top", "bottom", "upper", "lower", "height" and "side" and the like are utilized for convenience of description or for relative orientation, and are not necessarily intended to indicate an absolute orientation in space.

It will be appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification, including U.S. Pat. No. 5,026,063, are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A golf swing training club comprising:

(a) a shaft;

(b) a golf head attached to a first, lower end of said shaft; and (c) a handgrip attached to a second, upper end of said shaft;

wherein a portion of said shaft that is disposed between the handgrip and the golf head includes a braided layer;

wherein a longitudinal shaft bending angle (β) of said shaft is within a range of 45° to 90°;

β being defined as an angle that said shaft makes when said shaft is held horizontally, using a putting head having a standard weight of 350 grams, with said shaft being supported in a hold position solely on a side of said shaft that is proximal to said handgrip, such that a length of a free beam between said hold position and said putting head is 20 inches;

wherein a downward bend ($L_{dip}$) from horizontal and a resultant horizontal extension ($L_{hor}$) are measured in inches; and wherein β is calculated according to:

$$\beta=\tan^{-1}(L_{dip}/L_{hor});$$

and wherein a standard extensive shear modulus is determined by a shaft torque measuring machine having a torsion control head having a cradle adapted to receive said shaft, said torsion control head having a torsion arm adapted to receive a torsion weight so as to exert a predetermined load of 1 pound/foot;

and wherein a mechanical beam portion of the golf swing training club is characterized by said standard extensive shear modulus being at most 15°.

2. The golf swing training club of claim 1, wherein said longitudinal shaft bending angle (β) of said shaft is at least 70°.

3. The golf swing training club of claim 1, wherein said longitudinal shaft bending angle (β) of said shaft is within a range of 75° to 89°.

4. The golf swing training club of claim 1, wherein said braided layer includes a braided layer of metal.

5. The golf swing training club of claim 1, wherein said braided layer has a lazy tongs structure.

6. The golf swing training club of claim 1, wherein disposed within said braided layer is a tube having a flexural modulus of at most 0.01 GPa.

7. The golf swing training club of claim 1, wherein said golf head is a putting head.

8. The golf swing training club of claim 1, wherein said golf head is a driving head.

9. The golf swing training club of claim 1, wherein said golf head is an iron.

10. The golf swing training club of claim 1, wherein said portion of said shaft includes an element having a flexural modulus of at most 0.05 GPa.

11. The golf swing training club of claim 10, wherein said portion of said shaft includes an element having a shear modulus of at least 1.0 GPa.

12. The golf swing training club of claim 11, wherein said flexural modulus is at most 0.005 GPa.

13. The golf swing training club of claim 11, wherein said flexural modulus is at most 0.0015 GPa.

14. The golf swing training club of claim 10, wherein said shear modulus is at most 70 GPa.

15. The golf swing training club of claim 10, wherein said shear modulus is at most 40 GPa.

16. The golf swing training club of claim 10, wherein said shear modulus is at most 25 GPa.

17. The golf swing training club of claim 10, wherein said flexural modulus is at most 0.03 GPa.

18. A golf swing training club comprising:

(a) a shaft;

(b) a golf head attached to a first, lower end of said shaft; and (c) a handgrip attached to a second, upper end of said shaft;

wherein a portion of said shaft that is disposed between the handgrip and the golf head includes a braided layer;

wherein a longitudinal shaft bending angle (β) of said shaft is defined as an angle that said shaft makes when held horizontally, using a putting head having a standard weight of 350 grams, with said shaft being supported in a hold position solely on a side of said shaft that is proximal to said handgrip, such that a length of a free beam between said hold position and said putting head is 20 inches;

wherein a downward bend ($L_{dip}$) from horizontal and a resultant horizontal extension ($L_{hor}$) are measured in inches; wherein β is calculated according to:

$$\beta=\tan^{-1}(L_{dip}/L_{hor})$$

and wherein β is within a range of 45° to 90°;

and wherein a standard extensive shear modulus is determined by a shaft torque measuring machine having a torsion control head having a cradle adapted to receive said shaft, said torsion control head having a torsion arm adapted to receive a torsion weight so as to exert a predetermined load of 1 pound/foot;

and wherein a mechanical beam portion of the golf swing training club is characterized by said standard extensive shear modulus being at most 15°;

and wherein said braided layer has a lazy tongs structure.

19. The golf swing training club of claim 18, wherein said braided layer is a metal braided layer.

20. The golf swing training club of claim 18, wherein said standard extensive shear modulus is at least 2°.

* * * * *